US006037309A

United States Patent [19]

Bradbury et al.

[11] Patent Number: 6,037,309

[45] Date of Patent: Mar. 14, 2000

[54] DYE DIFFUSION THERMAL TRANSFER PRINTING

[75] Inventors: Roy Bradbury, St. Helens; Clive Muscrop, Heywood; Andrew Slark, Stokesley; Alan Butters, Ipswich, all of United Kingdom

[73] Assignee: Imperial Chemical Industries PLC, London, United Kingdom

[21] Appl. No.: 08/945,679

[22] PCT Filed: Apr. 30, 1996

[86] PCT No.: PCT/GB96/01027

§ 371 Date: Mar. 9, 1998

§ 102(e) Date: Mar. 9, 1998

[87] PCT Pub. No.: WO96/34766

PCT Pub. Date: Nov. 7, 1996

[30] Foreign Application Priority Data

| | | | |
|---|---|---|---|
| May 1, 1995 | [GB] | United Kingdom | 9508810 |
| May 2, 1995 | [GB] | United Kingdom | 9508874 |
| May 2, 1995 | [GB] | United Kingdom | 9508880 |

[51] Int. Cl.[7] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 3,940,246 | 2/1976 | Defago et al. | 8/2.5 A |
| 5,344,933 | 9/1994 | Mikoshiba et al. | 503/227 |
| 5,350,731 | 9/1994 | Williams et al. | 503/227 |

FOREIGN PATENT DOCUMENTS

| | | |
|---|---|---|
| 0 001 068 | 3/1979 | European Pat. Off. . |
| 0 229 374 | 7/1987 | European Pat. Off. . |
| 0 327 077 | 8/1989 | European Pat. Off. . |
| 0 400 706 | 12/1990 | European Pat. Off. . |
| 0 468 380 | 1/1992 | European Pat. Off. . |
| 0 526 170 | 2/1993 | European Pat. Off. . |
| 0 582 324 | 2/1994 | European Pat. Off. . |
| 0 613 783 | 9/1994 | European Pat. Off. . |
| 0 655 345 | 5/1995 | European Pat. Off. . |
| 2 136 457 | 12/1972 | France . |
| 38 29 918 | 3/1989 | Germany . |
| 2 159 971 | 12/1985 | United Kingdom . |

*Primary Examiner*—Bruce H. Hess
*Attorney, Agent, or Firm*—Pillsbury Madison & Sutro, LLP

[57] ABSTRACT

A dye diffusion thermal transfer printing dye sheet comprising a substrate having a coating comprising a dye of Formula (1):

Formula (1)

wherein

Ch is a chromogen;

$R^a$ and $R^b$ each independently is a spacer group;

Y is an interactive functional group selected from the group comprising OH and COOH;

w and x each independently is 0 or an integer equal to or greater than 1; and m and n each independently is an integer equal to or greater than 1, provided that w and x are not both equal to 0 and when one of w or x is 0 at least one of m and n is equal to or greater than 2 and when Y represents hydroxy, m+n is greater than 2.

28 Claims, No Drawings

DYE DIFFUSION THERMAL TRANSFER PRINTING

This invention relates to dye diffusion thermal transfer printing (DDTTP or D2T2 printing, D2T2 is a trade mark of Imperial Chemical Industries PLC), especially to a dye sheet carrying a dye or a dye mixture which has an improved print stability and to a transfer printing process in which the dye or the dye mixture is transferred from the transfer sheet to a receiver sheet by the application of heat.

It is known to print woven or knitted textile material by a thermal transfer printing (TTP) process. In such a process a sublimable dye is applied to a paper substrate (usually as an ink also containing a resinous or polymeric binder to bind the dye to the substrate until it is required for printing) in the form of a pattern, to produce a transfer sheet comprising a paper substrate printed with a pattern which it is desired to transfer to the textile. Substantially all the dye is then transferred from the transfer sheet to the textile material, to form an identical pattern on the textile material, by placing the patterned side of the transfer sheet in contact with the textile material and heating the sandwich, under light pressure from a heated plate, to a temperature from 180–220° C. for a period of 30–120 seconds.

As the surface of the textile substrate is fibrous and uneven it will not be in contact with the printed pattern on the transfer sheet over the whole of the pattern area. It is therefore necessary for the dye to be sublimable and vaporise during passage from the transfer sheet to the textile substrate in order for dye to be transferred from the transfer sheet to the textile substrate over the whole of the pattern area.

As heat is applied evenly over the whole area of the sandwich over a sufficiently long period for equilibrium to be established, conditions are substantially isothermal, the process is non-selective and the dye penetrates deeply into the fibres of the textile material.

In DDTTP, a transfer sheet is formed by applying a heat-transferable dye (usually in the form of a solution or dispersion in a liquid also containing a polymeric or resinous binder to bind the dye to the substrate) to a thin (usually <20 micron) substrate having a smooth plain surface in the form of a continuous even film over the entire printing area of the transfer sheet. Dye is then selectively transferred from the transfer sheet by placing it in contact with a material having a smooth surface with an affinity for the dye, hereinafter called the receiver sheet, and selectively heating discrete areas of the reverse side of the transfer sheet for periods from about 1 to 20 milliseconds (msec) and temperatures up to 300C, in accordance with a pattern information signal, whereby dye from the selectively heated regions of the transfer sheet diffuses from the transfer sheet to the receiver sheet and forms a pattern thereon in accordance with the pattern in which heat is applied to the transfer sheet. The shape of the pattern is determined by the number and location of the discrete areas which are subjected to heating and the depth of shade in any discrete area is determined by the period of time for which it is heated and the temperature reached.

Heating is generally, though not necessarily, effected by a line of heating elements, over which the receiver and transfer sheets are passed together. Each element is approximately square in overall shape, although the element may optionally be split down the centre, and may be resistively heated by an electrical current passed through it from adjacent circuitry. Each element normally corresponds to an element of image information and can be separately heated to 300° C. to 400° C., in less than 20 msec and preferably less than 10 msec, usually by an electric pulse in response to a pattern information signal. During the heating period the temperature of an element will rise to about 300–400° C. over about 5–8 msec. With increase in temperature and time more dye will diffuse from the transfer sheet to the receiver sheet and thus the amount of dye transferred onto, and the depth of shade at, any discrete area on the receiver sheet will depend on the period for which an element is heated while it is in contact with the reverse side of the transfer sheet.

As heat is applied through individually energised elements for very short periods of time the process is selective in terms of location and quantity of dye transferred and the transferred dye remains close to the surface of the receiver sheet.

As an alternative heating may be effected using a light source in a light-induced thermal transfer (LITT or L2T2 printing) printer where the light source can be focused, in response to an electronic pattern information signal, on each area of the transfer sheet to be heated. The heat for effecting transfer of the dye from the transfer sheet is generated in the dyesheet which has an absorber for the inducing light. The absorber is selected according to the light source used and converts the light to thermal energy, at a point at which the light is incident, sufficient to transfer the dye at that point to the corresponding position on the receiver sheet. The inducing light usually has a narrow waveband and may be in the visible, infra-red or ultra violet regions although infra-red emitting lasers are particularly suitable.

It is clear that there are significant distinctions between TTP onto synthetic textile materials and DDTTP onto smooth polymeric surfaces and thus dyes which are suitable for the former process are not necessarily suitable for the latter.

In DDTTP it is important that the surfaces of the transfer sheet and receiver sheet are even so that good contact can be achieved between the printed surface of the transfer sheet and the receiving surface of the receiver sheet over the entire printing area because it is believed that the dye is transferred substantially by diffusion in the molten state in condensed phases. Thus, any defect or speck of dust which prevents good contact over any part of the printing area will inhibit transfer and lead to an unprinted portion on the receiver sheet on the area where good contact is prevented, which can be considerably larger than the area of the speck or defect. The surfaces of the substrate of the transfer and receiver sheets are usually a smooth polymeric film, especially of a polyester, which has some affinity for the dye.

Important criteria in the selection of a dye for DDTTP are its thermal properties, fastness properties, such as light fastness, and facility for transfer by diffusion into the substrate in the DDTTP process. For suitable performance the dye or dye mixture should transfer evenly and rapidly, in proportion to the heat applied to the transfer sheet so that the amount transferred to the receiver sheet is proportional to the heat applied. After transfer the dye should preferably not migrate or crystallise and should have excellent fastness to light, heat, rubbing, especially rubbing with a oily or greasy object, e.g. a human finger, such as would be encountered in normal handling of the printed receiver sheet and when in contact with plastics materials containing plasticisers, particularly poly(vinyl chloride) e.g. by being placed in a wallet of such material.

The dye should be sufficiently mobile to migrate from the transfer sheet to the receiver sheet at the temperatures employed, 100–400° C., in the short time-scale, generally <20 msec. Many potentially suitable dyes are also not readily soluble in the solvents which are commonly used in, and thus acceptable to, the printing industry; for example, alcohols such as i-propanol, ketones such as methyl ethyl ketone (MEK), methyl i-butyl ketone (MIBK) and cyclohexanone, ethers such as tetrahydrofuran and aromatic hydrocarbons such as toluene. The dye can be applied as a dispersion in a suitable medium or as a solution in a suitable solvent to the substrate from a solution. In order to achieve the potential for a high optical density (OD) on the receiver sheet it is desirable that the dye should be readily soluble or readily dispersable in the ink medium. It is also important that a dye which has been applied to a transfer sheet from a solution should be resistant to crystallisation so that it remains as an amorphous layer on the transfer sheet for a considerable time. Crystallisation not only produces defects which prevent good contact between the transfer receiver sheet but gives rise to uneven prints.

The following combination of properties is highly desirable for a dye which is to be used in DDTTP:

Ideal spectral characteristics (narrow absorption curve and high tinctorial strength)

Correct thermochemical properties (high thermal stability and efficient transferability with heat).

High optical densities on printing.

Good solubility in solvents acceptable to printing industry: this Is desirable to produce solution coated dyesheets alternatively good dispersibility in acceptable media is desirable to produce dispersion coated dyesheets.

Stable dyesheets (resistant to dye migration or crystallisation).

Stable printed images on the receiver sheet (resistant to heat, migration, crystallisation, grease, rubbing and light).

DDTTP is used for printing images on suitable substrates.

The achievement of good light fastness in DDTTP is extremely difficult because of the unfavourable environment of the dye, close to the surface of the receiver sheet. To preserve an image on a receiver sheet it is important to minimise migration and/or crystallisation of the dye. An objective of the present invention is to overcome the above problems by providing a convenient means of enhancing print stability and minimising migration and crystallisation of dyes in DDTTP without the disadvantage of substantially changing the absorption maximum of the dye.

According to the present invention there is provided a thermal transfer dye sheet comprising a substrate having a coating comprising a dye of Formula (1):

Formula (1)

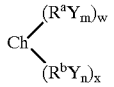

wherein

Ch is a chromogen;

$R^a$ and $R^b$ each independently is a spacer group;

Y is an interactive functional group;

w and x each independently is 0 or an integer equal to or greater than 1; and m and n each independently is an integer equal to or greater than 1, provided that w and x are not both equal to zero and when one of w or x is 0 at least one of m and n is equal to or greater than 2.

In this specification, the term "chromogen" is defined as meaning the arrangement of atoms which governs the absorbance of electromagnetic radiation by the dye molecule and particularly in the case opf visible radiation, the arrangement of atoms which causes the dye molecule to be coloured.

The chromogen represented by Ch is preferably an optionally substituted group of Formula (2):

Formula (2)

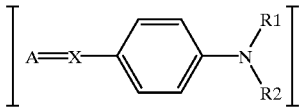

or an optionally substituted group of Formula (2B):

Formula (2B

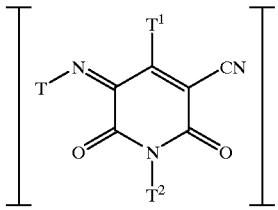

in which T is $A^1$-NH or optionally substituted phenyl (such as optionally substituted mono- or dialkylaminophenyl), $T^1$ is optionally substituted $C_{1-12}$-alkyl or optionally substituted aryl, and $T^2$ is optionally substituted alkyl; or an optionally substituted group of Formula (3):

Formula (3)

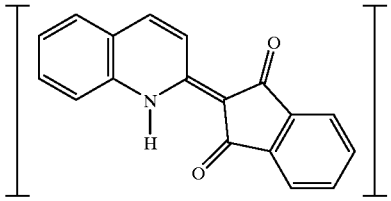

or an optionally substituted group of Formula (4):

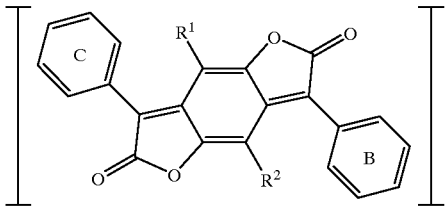

in which rings A and B are optionally substituted and $R^1$ and $R^2$ each independently is H, alkyl, alkoxy or halogen; or an optionally substituted group of Formula (5):

Formula (5)

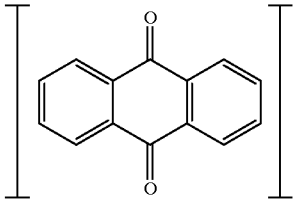

in which

X is —C(R)— or N and R is H, CN or COOalkyl; and

A is $A^1$-N in which $A^1$ is the residue of a diazotisable aromatic or heteroaromatic amine or A is selected from an optionally substituted group of Formula (6):

Formula (6)

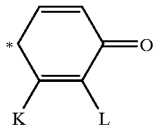

in which K and L each independently is —CN, $NO_2$, —Cl, —F, —Br, $C_{1-6}$ alkyl, $C_{1-6}$ alkoxy, —$NHCOC_{1-6}$ alkyl, —NHCOphenyl, —$NHSO_2$ alkyl, $NHSO_2$phenyl or aryloxy, or K and L together with the carbon atoms to which they are attached form a 5- or 6-membered carbocyclic or hetrocyclic ring; or an optionally substituted group of Formula (7):

Formula (7)

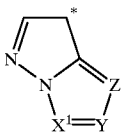

wherein $X^1$, Y and Z each independently is N or C—$R^3$ in which $R^3$ is —H, —CN alkyl, alkoxy, cycloalkyl, aryl, aralkyl, aryloxy or amino; or an optionally substituted group of Formula (8):

Formula (8)

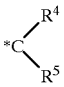

wherein $R^4$ and $R^5$ each independently is an electron withdrawing group or $R^4$ and $R^5$ may be joined form a heterocyclic ring such as;

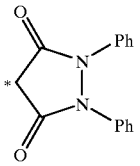

an optionally substituted group of Formula (9):

Formula (9)

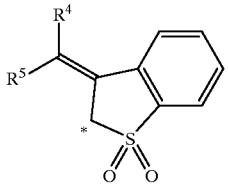

wherein $R^4$ and $R^5$ are as hereinbefore defined; or an optionally substituted group of Formula (10):

Formula (10)

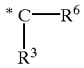

wherein $R^3$ is as hereinbefore defined and $R^6$ is alkenyl or

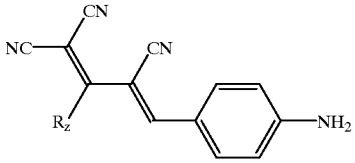

wherein $R^z$ is $NH_2$, phenyl or succinamido; or an optionally substituted group of Formula (11):

Formula (11)

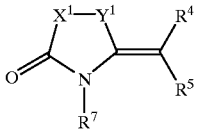

in which $X^1$ and $Y^1$ are both C and $R^4$ and $R^5$ are as hereinbefore defined and $R^7$ is —H, alkyl or aryl, where * shows the point of attachment to the double bond in Formula (2).

$A^1$ is preferably selected from phenyl, naphthyl, thiazolyl, isothiazolyl, benzothiazolyl, benzoisothiazolyl, pyrazolyl, thiadiazolyl, imidazolyl, thienyl, pyridyl and pyridoisothiazolyl each of which may be optionally substituted.

Where $A^1$ is phenyl it is preferably of the Formula (12):

Formula (12)

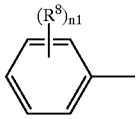

wherein:

$R^8$ is —H, optionally substituted alkyl, optionally substituted alkoxy, —$NO_2$, —CN, —$CF_3$, —SCN, halogen, alkoxyalkyl, —COalkyl, —OCOalkyl, —COOalkyl, —$SO_2NH_2$, —$SO_2F$, —$SO_2Cl$, —$CONH_2$, —COF, —COCl, —$SO_2$alkyl, —CONH(alkyl), —CON(alkyl)$_2$, —$SO_2N$(alkyl)$_2$, —Salkyl, —Sphenyl; and $n^1$ is an integer from 1 to 5.

Where $A^1$ is naphthyl it is preferably a naphth-1-yl of the Formula (13):

Formula (13)

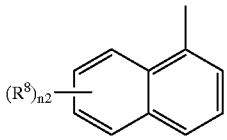

wherein:

$R^8$ is as hereinbefore defined; and $n^2$ is an integer from 1 to 4.

Where $A^1$ is thiazolyl it is preferably a thiazol-2-yl of the Formula (14):

Formula (14)

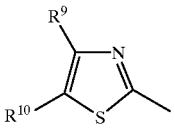

wherein:

$R^9$ is —H or optionally substituted alkyl, optionally substituted alkoxy, optionally substituted aryl, halogen or —Salkyl; and $R^{10}$ is —H, optionally substituted alkyl, alkenyl, —CN, —$NO_2$, —$SO_2$alkyl, —COOalkyl, halogen or —CHO.

Where $A^1$ is isothiazolyl it is preferably an isothiazol-5-yl of the Formula (15):

Formula (15)

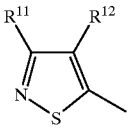

wherein:

$R^{11}$ is —H, optionally substituted alkyl, optionally substituted aryl, —$SO_2$alkyl, —Salkyl, —Saryl or halogen; and $R^{12}$ is —H, —CN, —$NO_2$, —SCN or —COOalkyl.

Where $A^1$ is benzothiazolyl it is preferably a benzothiazol-2-yl of the Formula (16):

Formula (16)

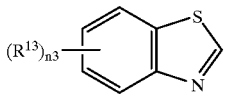

wherein:

$R^{13}$ is —H, —SCN, —$NO_2$, —CN, halogen, optionally substituted alkyl, optionally substituted alkoxy, —COOalkyl, —OCOalkyl or —$SO_2$alkyl; and $n^3$ is from 1 to 4.

Where $A^1$ is benzoisothiazolyl it is preferably a benzoisothiazol-3-yl of the Formula (17):

Formula (17)

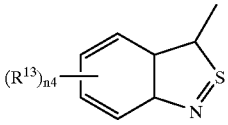

wherein:

$R^{13}$ is as hereinbefore defined; and $n^4$ is from 1 to 4.

Where $A^1$ is pyrazolyl it is preferably a pyrazol-5-yl of the Formula (18):

Formula (18)

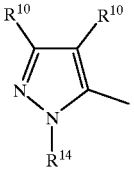

wherein:

each $R^{10}$ is independently as hereinbefore defined; and $R^{14}$ is —H, optionally substituted alkyl or optionally substituted aryl.

Where $A^1$ is thiadiazolyl it is preferably a 1,2,4thiadiazol-5-yl of Formula (19):

Formula (19)

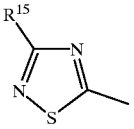

wherein:

$R^{15}$ is —Salkyl, —Saryl, —$SO_2$alkyl or halogen or is a 1,3,4-thiadiazol-5-yl of Formula (20)

Formula (20)

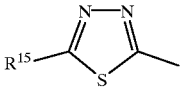

wherein:

$R_{15}$ is as hereinbefore defined.

Where $A^1$ is imidazolyl it is preferably an imidazol-2-yl of the Formula (21):

Formula (21)

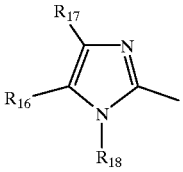

wherein:

$R_{16}$ is —CN, —CHO, —CH═C(CN)$_2$ or —CH═C(CN)(COOalkyl);

$R_{17}$ is —CN or —Cl; and $R_{18}$ is —H or optionally substituted alkyl.

Where $A^1$ is thienyl it is preferably a thien-2-yl of the Formula (22):

Formula (22)

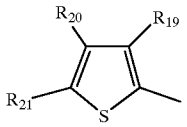

wherein:

$R_{19}$ is —$NO_2$, —CN, alkylcarbonylamino or alkoxycarbonyl;

$R_{20}$ is —H, halogen, optionally substituted alkyl, optionally substituted alkoxy, optionally substituted aryl or —Salkyl; and $R_{21}$ is —H, optionally substituted alkyl, —CN, —$NO_2$, —$SO_2$alkyl, —COOalkyl, halogen, —CH═C(CN)$_2$ or —CH═C(CN)(COOalkyl).

Where $A^1$ is pyridyl it is preferably a pyrid-2-yl, pyrid-3-yl or pyrid-4-yl of the Formula (23):

Formula (23)

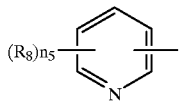

wherein:

$R_8$ is as hereinbefore defined; and $n_5$ is from 1 to 4.

Where $A^1$ is pyridoisothiazolyl it is preferably a pyridoisothiazol-3-yl of the Formula (24):

Formula (24)

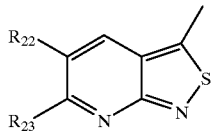

wherein:

$R_{22}$is —CN or —$NO_2$; and $R_{23}$ is optionally substituted alkyl.

According to a preferred aspect of the invention, the chromogen contains an α-branched, N-alkyl group.

The inclusion of such a group increases the resistance to fading under the influence of light.

The spacer groups represented by $R^a$ and $R^b$ may be any groups capable of carrying one or more interactive functional groups m and minimising steric and electronic effects of the Y group and thereby minimising any changes in the absorption characteristics of the chromogen group Ch and thus shade which the Y group would otherwise cause.

Preferably the spacer groups each comprise an atom or group of atoms connected to the chromagen by at least one sigma bond and to the interactive group by at least one sigma bond.

The spacer groups may contain at least one of a carbon, silicon or sulphur atom, preferably two carbon atoms and more preferably from three to ten carbon atoms.

The interactive functional group represented by Y are such that the Y groups on different dye molecules may be interact with each other to form dye complexes of larger size and thus of lower mobility and/or the Y groups may interact with a dye receptive polymer on the receiver sheet. In the dyes of Formulae (1) to (5) the Y groups may be the same or different and the $R^a$ and $R^b$ may carry one more Y groups. The interactions between different Y groups or between the Y groups and the dye receptive polymer produces an image on the receiver sheet which is resistant to crystallisation and migration of the dyes is minimised. The Y groups are preferably selected from OH, $NH_2$, NHR, $NR_2$, COOH, $CONH_2$, NHCOR, CONHR, $SO_2NH_2$, $SO_2NHR$, $SO_3H$, $NHCONH_2$, NHCONHR, ═NOH, and $PO_3H$, in which R is selected from —CN, $NO_2$, —Cl, —F, —Br, —$C_{1-6}$alkyl, $C_{1-6}$alkoxy, —NHCO$C_{1-6}$alkyl, —NHCOphenyl, —$NHSO_2$alkyl, —$NHSO_2$phenyl or aryloxy, more preferably from the groups having at least one H atom.

Dyes with low melting points are generally unsuitable for use in DDTTP because they migrate within the receiver sheet or retransfer to materials to which they are in contact. It is surprising therefore that dyes of the present invention which have melting points as low as 20° C. produce images on the receiver sheets which do not migrate.

According to a preferred feature of the invention, the dye sheet contains a dye of Formula (1) which is liquid at room temperature or which has a melting point in the range from 20° C. to 200° C., preferably in the range from 20° C. to 150° C.

The dyes for use in the dye sheet of the invention may be prepared by conventional methods such as those described in EP285665, EP400706, EP483791. For more detailed information on the preparation of the dyes disclosed herein, reference may be made to the co-pending PCT application in the name of Zeneca Limited and claiming priority from GB 9508810.0.

The Coating

The coating suitably comprises a binder together with a dye or mixture of dyes of Formula (1). The ratio of binder to dye is preferably at least 0.7:1 and more preferably from 1:1 to 4:1 and especially preferably 1:1 to 2:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye to the substrate which has acceptable solubility in the ink medium, i.e. the medium in which the dye and binder are applied to the transfer sheet. It is preferred however, that the dye is soluble in the binder so that it can exist as a solid solution in the binder on the transfer sheet. In this form it is generally more resistant to migration and crystallisation during storage. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral, polyvinyl acetoacetal and polyvinyl pyrrolidone; polycarbonates such as AL-71 from Mitsubishi Gas Chemicals and MAKROLON 2040 from Bayer (MAKROLON is a trade mark); polymers and co-polymers derived from acrylates and acrylate derivatives, such as polyacrylic acid, polymethyl methacrylate and styrene-acrylate copolymers, styrene derivatives such as polystyrene, polyester resins, polyamide resins, such as melamines; polyurea and polyurethane resins; organosilicones, such as polysiloxanes, epoxy resins and natural resins, such as gum tragacanth and gum arabic. Mixtures of two or more of the above resins may also be used, mixtures preferably comprise a vinyl resin or derivative and a cellulose derivative, more preferably the mixture comprises polyvinyl butyral and ethylcellulose. It is also preferred to use a binder or mixture of binders which is soluble in one of the above-mentioned commercially acceptable organic solvents.

The dye or mixture of dyes of Formula (1) has good thermal properties giving rise to even prints on the receiver sheet, whose depth of shade is accurately proportional to the quantity of applied heat so that a true grey scale of coloration can be attained.

The dye or mixture of dyes of Formula (1) also has strong absorbance properties and is soluble in a wide range of solvents, especially those solvents which are widely used and accepted in the printing industry, for example, alkanols, such as i-propanol and butanol; aromatic hydrocarbons, such as toluene, ethers, such as tetrahydrofuran and ketones such as MEK, MIBK and cyclohexanone. Alternatively the mixture of dyes may be dispersed by high shear mixing in suitable media such as water, in the presence of dispersing agents. This produces inks (solvent plus mixture of dyes and binder) which are stable and allow production of solution or dispersion coated dyesheets. The latter are stable, being resistant to dye crystallisation or migration during prolonged storage.

The combination of strong absorbance properties and good solubility in the preferred solvents allows the achievement of good OD of the dye or mixture of dyes of Formula (1) on the receiver sheet. The transfer sheets of the present invention have good stability and produce receiver sheets with good OD and which are fast to both light and heat.

The Substrate

The substrate may be any sheet material preferably having at least one smooth even surface and capable of withstanding the temperatures involved in DDTTP, i.e. up to 400° C. for periods up to 20 msec, yet thin enough to transmit heat applied on one side through to the dyes on the other side to effect transfer of the dye onto a receiver sheet within such short periods. Examples of suitable materials are polymers, especially polyester, polyacrylate, polyamide, cellulosic and polyalkylene films, metallised forms thereof, including co-polymer and laminated films, especially laminates incorporating a smooth even polyester receptor layer on which the dye is deposited. Thin (<20 micron) high quality paper of even thickness and having a smooth coated surface, such as capacitor paper, is also suitable. A laminated substrate preferably comprises a backcoat, on the opposite side of the laminate from the receptor layer, which, in the printing process, holds the molten mass together, such as a thermosetting resin, e.g a silicone, acrylate or polyurethane resin, to separate the heat source from the polyester and prevent melting of the latter during the DDTTP operation. The thickness of the substrate depends to some extent upon its thermal conductivity but it is preferably less than 20 $\mu$m and more preferably less than 10 $\mu$m.

The DDTTP Process

According to a further feature of the present invention there is provided a dye diffusion thermal transfer printing process which comprises contacting a transfer sheet comprising a coating comprising a dye or mixture of dyes of Formula (1) with a receiver sheet, so that the coating is in contact with the receiver sheet and selectively applying heat to discrete areas on the reverse side of the transfer sheet whereby the dye on the opposite side of the sheet to the heated areas is transferred to the receiver sheet.

Heating in the selected areas may be effected by contact with heating elements, which can be heated to 200–450° C., preferably 200–400° C., over periods of 2 to 10 msec, whereby the dye mixture may be heated to 150–300° C., depending on the time of exposure, and thereby caused to transfer, substantially by diffusion, from the transfer to the receiver sheet. Good contact between coating and receiver sheet at the point of application is essential to effect transfer. The density of the printed image is related to the time period for which the transfer sheet is heated.

Alternatively, the heating may be effected by means of a laser in which case the dye coat contains an absorber material for absorbing and converting light radiation to heat.

The Receiver Sheet

The receiver sheet conveniently comprises a polymeric sheet material, preferably a white polymeric film and more preferably a material capable of interacting with the interactive functional group(s) defined by Y. The design of receiver and transfer sheets is discussed further in EP 133,011 and EP 133012.

According to a further aspect of the invention, there is provided a thermal transfer printing dye sheet/receiver sheet combination in which the dye sheet comprises a coating comprising a dye or mixture of dyes of Formula (1) and in which the receiver sheet contains at least one polymer capable of interacting with Y.

The invention is further illustrated by the following examples in which all parts and percentages are by weight. The structures of specific dyes suitable for use in the dye sheet of the invention are listed at end of the descriptive part of this specification and the test results given in the Tables have corresponding numbers. It is to be noted that Dyes 1, 2, and 3 are dyes as currently used in commercially available dye sheets.

EXAMPLE 1

A dye sheet was produced by coating a 6 micron thick poly ethylene terephthalate substrate supplied by Diafoil with a solution containing 1.41% w/w dye and 2.8% w/w poly (vinyl butyral) in tetrahydrofuran using a K3 wire bar and drying the coating at 110° C. for 20 seconds to 1.0 $\mu$m thickness.

A receiver sheet was prepared by coating a Melinex 990® substrate with a solution containing 11.1% w/w of poly (vinyl pyridene) and a cross linked hydroxy functional silicone as release agent, using a K4 wire bar and dried at 140° C. for 3 minutes to give a final coat of 4 $\mu$m.

Sample prints having an area of 16 $cm^2$ were made using a laboratory thermal printer having a TDK L-335H print head operating at a head voltage of 12v for 14 msecs. After measuring the optical density using a Macbeth densitometer, the dyed face of a first sample, was covered with a section of plasticised (18% octyl phthalate) PVC wallet making sure the rough surface of the wallet was in contact with the surface of the print. A laboratory tissue was then placed on top of the laminated sample, the next print was placed on the tissue and then covered with a section of plasticised PVC wallet in the same way as before. This procedure was repeated to provide a stack of 10 samples.

The final print was then covered with a laboratory tissue and the whole 'stack' of prints was placed between two glass plates, printed faces uppermost, in a humidity oven at 45° C. 85% relative humidity (RH). A 5 kg weight was then placed on top of the whole assembly which was left in the oven for 16 hours.

After the 16 hour period had elapsed, the samples were removed from the oven and the PVC wallet was peeled from the print surface. The optical density of the relief image on the contacting surface of the PVC was then measured, at least four different places. The final values used were the average of these four measurements. The recorded retransfer optical density was then divided by the initial optical density of the print to obtain the percentage (%) re-transfer.

The results for various dyes are shown in Table 1.

Further samples were prepared in similar manner except that each sample was printed with four areas using print times of 6.6, 8.8, 10.9 and 13.1 msecs. Each area was subjected to a fingerprint from a different person and the samples were then placed in the oven for 16 days. At the end of this period, the samples were examined by eye to determine any defects, each area being given a score of from 0 to 5, a score of 0 indicating the print was unaffected and a score of 5 indicating the quality of the print had been substantially impaired. The scores for the four areas were summated and the final scores are shown in Table 1, lower values indicating better resistance to fingerprint damage.

EXAMPLE 2

Example 1 was repeated (and the samples subjected to the wallet test) for Dyes 1, 37, 38, 39 and 40 except that the dyesheet contained 2.1% dye and 2.1% binder and the receiver contained 11.1% of an amorphous polyester (Vylon 103®). The results are shown in Table 2.

EXAMPLE 3

Example 2 was repeated except that the polyester in the receiver sheet was replaced with a vinyl pyrrolidone/vinyl acetate resin. The results are shown in Table 3.

EXAMPLE 4

Example 2 was repeated using poly (vinyl pyridine) in place of the polyester In the receiver sheet. The results are shown in Table 4.

EXAMPLE 5

Example 1 was repeated using Dyes 1, 40, 41, and 42 to provide samples having two areas produced using different print times. The samples were subjected to the wallet test and the results are shown in Table 5.

EXAMPLE 6

Example 5 was repeated except that the polyester was replaced in the receiver sheet with a vinyl pyrrolidone/vinyl acetate resin. The results are shown in Table 6.

EXAMPLE 7

Preparation of Dye 4 i) Synthesis of 3-cyano-1-(3-hydroxy-2,2-dimethylpropyl)-6-hydroxy-4-methylpyrid-2-one Ethyl acetoacetate (13 g) and ethyl cyanoacetate (11.3 g) were added sequentially to a mixture of neo-pentanolamine (25.7 g) and water (5 $cm^3$) keeping the temperature <10C. The mixture was then refluxed for 16 hrs before drowning into water (50 $cm^3$). The aqueous solution was acidified with hydrochloric acid. The pinkish coloured solid which precipitated on stirring for several hours was isolated by filtration, washed with water and dried under reduced pressure. Yield −13.1 g ii) 4Amino-N,N-bis-(2-hydroxyethyl) benzenesulphonamide (2.6 g) was stirred in water (20 $cm^3$) and hydrochloric acid (3 $cm^3$) added. After cooling to <10C a solution of sodium nitrite (0.8 g) in the minimum of water was added keeping the temperature <10° C. After stirring for 0.25 hr excess nitrous acid was destroyed by the addition of sulphamic acid. The resulting diazonium salt solution was added dropwise to a suspension of 3-cyano-6-hydroxy-4-methyl-1,3-hydroxy-2,2-dimethylpropylpyrid-2-one (2.4 g) in methanol (50 $cm^3$). After stirring for 0.5 hr the yellow product was isolated by filtration, washed and recrystallised from ethanol to give 4 g (80% ) of pure product having melting point 268–270° C. ($\lambda_{max}$ ($CH_2CH_2$)=432 nm).

EXAMPLE 8

Preparation of Dye 7 i) 3-(3-Aminophenyl)propionic acid

3-Nitrocinnamic acid (50 g) was suspended in ethanol (600 $cm^3$) and reduced in the presence of palladium catalyst until no further hydrogen uptake was observed. After filtering the solvent was evaporated under reduced pressure to give the pure product in quantitative yield as a brown oil which slowly crystallised.

ii) 3-(3-Aminophenyl)propionic acid (0.83 g) was added to a solution of hydrochloric acid (3 $cm^3$) in water (20 $cm^3$ at 0C. A solution of sodium nitrite (0.35 g) in the minimum of water was then added dropwise keeping the temperature below 5C. After stirring for 0.25 hrs the excess nitrous acid was destroyed with sulphamic acid and the diazonium salt solution filtered before adding slowly to a cooled solution of 1-carboxymethyl-3-cyano-6-hydroxy4-methylpyrid-2-one (1.04 g) in methanol (50 $cm^3$). After stirring for 1 hr the yellow product was filtered off washed with water and methanol and dried (81% ). mp 258–60C, λ max ($CH_2CH_2$) 434 nm.

EXAMPLE 9

Preparation of Dye 8

4-(4-Cyano-3-methylisothiazol-5-ylazo)-N,N-bis-(2-hydroxyethyl)-3-toluidine (3.45 g) and glutaric anhydride (5.0 g) were refluxed in pyridine (20 $cm^3$) until TLC showed complete reaction. The cooled solution was poured into water (200 $cm^3$ and acidified with hydrochloric acid. The precipitated product was filtered off, washed with water and dried under reduced pressure to give analytically pure product (82%).

EXAMPLE 10

Preparation of Dye 10

This product was synthesised in analogous manner to Example 9 replacing the 4-(4-cyano-3-methylisothiazol-5-ylazo)-N,N-bis-(2-hydroxyethyl)-3-toluidine by N,N-bis-(2-hydroxyethyl)- 4-(5-nitrobenzoisothiazol-7-ylazo)-3-toluidine (4.05 g) and the glutaric anhydride by succinic anhydride (4.4 g).

EXAMPLE 11

Preparation of Dye 11

To a solution of N,N-Bis-(2-hydroxyethyl)-4-formyl-3-toluidine (3.85 g) and malononitrile (1.14 g) in ethanol (20 $cm^3$) was added a few drops of piperidine. The solution was refluxed for 0.5 hr, cooled and poured into water (150 $cm^3$). The resulting product was filtered off washed and dried. Reaction as described in Example 9 using succinic anhydride yielded a yellow solid (86% )

EXAMPLE 12

Preparation of Dye 13 i) Aniline (37.2 g), 3-chloropropan-1-ol (113.4 g), and calcium carbonate (60 g) in water (500 $cm^3$) were refluxed for 30 hrs. The resulting mixture was filtered and the filtrate separated into an oil and a water layer, the oil was dissolved in dichloromethane and the solvent removed to leave N,N-bis(3-hydroxypropyl)aniline as a brown oil.

ii) N,N-bis(3-hydroxypropyl) aniline (10.46 g) was dissolved in hydrochloric acid (20 $cm^3$) at 0–5C and sodium nitrite(3.45 g) in water(15 $cm^3$) was added dropwise. The mixture was stirred for 1 hr, water (10 $cm^3$) was added, made alkaline with sodium carbonate, separated in to an oil and water layer. The oil was dissolved in dichloromethane and the solvent removed to leave iii) Iron powder (6.72 g), N,N-bis(3-hydroxypropyl)-4-nitrosoaniline (10 g) and hydrochloric acid(20 $cm^3$) in methanol (120 $cm^3$) were refluxed for 2 hrs. The resulting mixture was made alkaline with sodium carbonate, filtered and the solvent removed to leave N,N-bis(3-hydroxypropyl)-4-aminoaniline as a brown solid.

iv) Ammonium persulphate (9.13 g) was added portionwise with stirring to a mixture of N,N-bis(3hydroxypropyl)-4-aminoaniline(4.48 g), 3-cyano-6-hydroxy-4-methyl-1-neopentyl (4.73 g), sodium carbonate (4.24 g) and acetone (30 $cm^3$) in water (cm), stirred for 1 hr, acetone removed and the resulting solution was extracted with ethyl acetate (3×200 $cm^3$) and the combined extracts dried over magnesium sulphate, filtered and solvent removed to leave the title compound. m.p.166C, λmax 569 nm (methanol). Mmax 25370

EXAMPLE 13

Preparation of Dye 17

The diethylester (1.5 g, 0.003mol) was dissolved in methanol (30 $cm^3$) and 48% sodium hydroxide solution (0.5 $cm^3$) added, reaction stirred and refluxed for 1 hr. The mixture was poured into water (150 $cm^3$) acidified with concentrated HCl and precipitated solid filtered off, washed with water and dried (1 g, 74% ). λmax (MeOH) 524 nm

EXAMPLE 14

Preparation of Dye 24

1,4-Diaminoanthraquinone (3.6 g, 0.015 mol) and acrylic acid (30 $cm^3$) were stirred at 100–110C for 1 phrs, allowed to cool and diluted with methanol (45 $cm^3$). After cooling to room temperature, the product was filtered off, washed with methanol and dried (4.9 g, 86% ). λmax (MeOH) 570 nm.

EXAMPLE 15

Preparation of Dye 26

Using diaminoanthrarufin in the procedure described in Example 14 above gave the required product. λmax (MeOH) 660+610 nm.

EXAMPLE 16

Preparation of Dye 31

The procedure as described for Example 9 was followed except the 4-(4-cyano-3-methylisothiazol-5-ylazo)-N-N-bis(2-hydroxyethyl)-3-toluidine was replaced by 4-(4-ethylhydroxyphenylazo)-N-N-bis(2-hydroxyethyl)-3-aminoacetanilide to give the title compound, λmax 464 nm (water).

EXAMPLE 17

Preparation of Dye 35

4-(4-Cyano-3-methylisothiazol-5-ylazo)-N,N-bis(3-ethoxycarbonylpropyl)-3-toluidine (1.4 g), methanol (30 $cm^3$) and sodium hydroxide liquor (0.5 $cm^3$, 40% w/w) were stired and heated to reflux for 1 hr when TLC showed complete hydrolysis. The cooled mixture was poured into water (150 $cm^3$) and the solution acidified with hydrochloric acid. The precipitated product was isolated by filtration, washed with water and dried to give 0.96 g of product mp 166–9C. λmax (acetone) 548 nm.

EXAMPLE 18

Preparation of Dye 36

To N,N-dicarboxyethyl-3-toluidine (2.51 g, 0.01 mol) and dimethylformamide (5 $cm^3$) was added tetracyanoethylene (1.28 g, 0.01 mol) over 15 mins; keeping the temperature below 40C. Reaction mixture heated to 55C for phr, solution cooled, poured into ice/water to give a sticky solid. Solid purified by column chromatography (silica; ethylacetate) to give a black solid (1 g, 28% ). λmax (MeOH) 524 nm.

TABLE 1

| DYE | OPTICAL DENSITY | % RE-TRANSFER | FINGERPRINT SCORE |
|---|---|---|---|
| 1 | 0.85 | 25.9 | 8 |
| 2 | 0.63 | 17.5 | 20 |
| 3 | 0.9 | 21.1 | 10 |
| 4 | 0.6 | 3.3 | — |
| 5 | 0.43 | 0 | 5 |
| 6 | 0.71 | 1.4 | 6 |
| 7 | 1.23 | 0.8 | 4 |
| 8 | 1.3 | 0.8 | 2 |
| 9 | 0.7 | 0 | 13 |
| 10 | 0.93 | 0 | 2 |
| 11 | 1.29 | 0 | 1 |
| 12 | 0.72 | 1.4 | 3 |
| 13 | 0.86 | 2.3 | — |
| 14 | 0.6 | 1.7 | — |
| 15 | 0.6 | 21.7 | 1 |
| 16 | 0.62 | 0 | 1 |
| 17 | 0.96 | 0 | 9 |
| 18 | 0.17 | 0 | 5 |
| 19 | 0.83 | 0 | 11 |
| 20 | 0.91 | 0 | 6 |
| 21 | 1.01 | 2.0 | 3 |
| 22 | 0.55 | 0 | 3 |
| 23 | 0.35 | 0 | 5 |
| 24 | 0.46 | 0 | 7 |
| 25 | 0.55 | 0 | 4 |
| 26 | 0.53 | 0 | 5 |
| 27 | 0.64 | 0 | — |
| 28 | 0.24 | 0 | 11 |
| 29 | 0.55 | 0 | 2 |
| 30 | 1.47 | 0.7 | 1 |
| 31 | 0.62 | 0 | 0 |
| 32 | 0.41 | 0 | 7 |
| 33 | 0.76 | 0 | 11 |
| 34 | 1.48 | 2.03 | — |
| 35 | 1.6 | 0.63 | — |
| 36 | 1.3 | 0.8 | — |

TABLE 2
| DYE | ORIGINAL OD | TRANSFER OD | % LOSS |
|---|---|---|---|
| 1 | 2.42 | 0.30 | 12.4 |
| 37 | 1.24 | 0.09 | 7.3 |
| 38 | 1.60 | 0.07 | 4.4 |
| 39 | 2.05 | 0.26 | 12.6 |
| 40 | 1.77 | 0.08 | 4.5 |
TABLE 3
| DYE | ORIGINAL OD | TRANSFER OD | % LOSS |
|---|---|---|---|
| 1 | 2.16 | 0.96 | 44.4 |
| 37 | 1.82 | 0.00 | 0.0 |
| 38 | 2.03 | 0.00 | 0.0 |
| 39 | 2.18 | 0.05 | 2.3 |
| 40 | 2.06 | 0.00 | 0.0 |
TABLE 4
| DYE | ORIGINAL OD | TRANSFER OD | % LOSS |
|---|---|---|---|
| 1 | 1.66 | 0.49 | 29.5 |
| 37 | 1.39 | 0.00 | 0.0 |
| 38 | 1.65 | 0.00 | 0.0 |
| 39 | 1.89 | 0.10 | 5.3 |
| 40 | 1.73 | 0.00 | 0.0 |
TABLE 5
| DYE | PRINT TIME mS | ORIGINAL OD | TRANSFER OD | % LOSS |
|---|---|---|---|---|
| 1 | 8.5 | 1.20 | 0.29 | 24.2 |
| 1 | 10.6 | — | — | — |
| 40 | 8.5 | 0.26 | 0.02 | 7.70 |
| 40 | 10.6 | 0.67 | 0.02 | 2.99 |
| 41 | 8.5 | 0.28 | 0.01 | 3.60 |
| 41 | 10.6 | 0.68 | 0.01 | 1.47 |
| 42 | 8.5 | 0.25 | 0.01 | 4.10 |
| 42 | 10.6 | 0.64 | 0.01 | 1.56 |
TABLE 6
| DYE | PRINT TIME mS | ORIGINAL OD | TRANSFER OD | % LOSS |
|---|---|---|---|---|
| 1 | 8.5 | 0.93 | 0.64 | 68.90 |
| 1 | 10.6 | 1.86 | 0.63 | 33.90 |
| 1 | 12.7 | 2.04 | 0.97 | 47.50 |
| 40 | 8.5 | 0.37 | 0.00 | 0.00 |
| 40 | 10.6 | 0.90 | 0.00 | 0.00 |
| 40 | 12.7 | 1.48 | 0.00 | 0.00 |
| 41 | 8.5 | 0.36 | 0.00 | 0.00 |
| 41 | 10.6 | 0.91 | 0.00 | 0.00 |
| 41 | 12.7 | 1.25 | 0.00 | 0.00 |
| 42 | 8.5 | 0.48 | 0.00 | 0.00 |
| 42 | 10.6 | 1.00 | 0.01 | 1.00 |
| 42 | 12.7 | 1.35 | 0.02 | 1.50 |
(1)
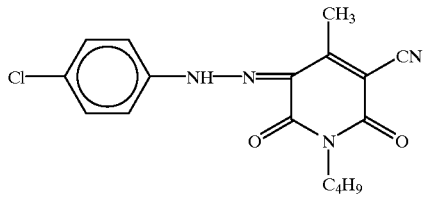
(2)
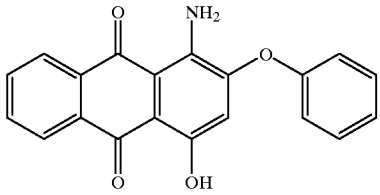
(3)
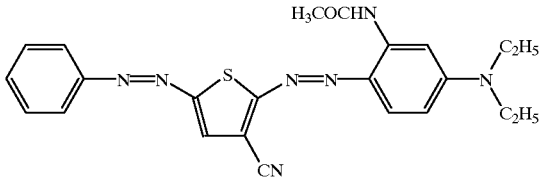

-continued
(4)
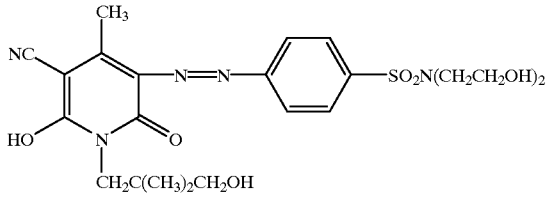
(5)
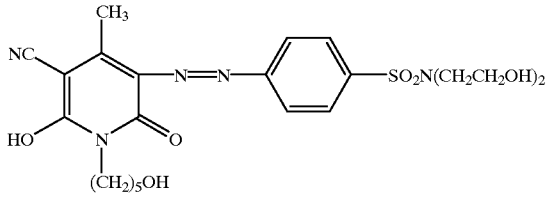
(6)
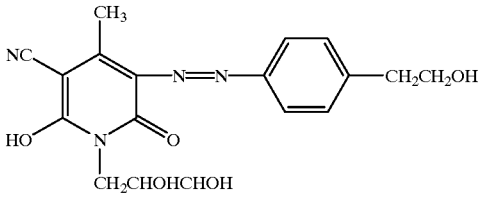
(7)
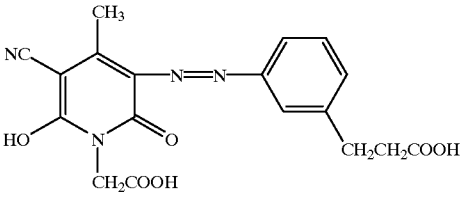
(8)
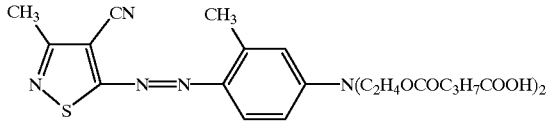
(9)
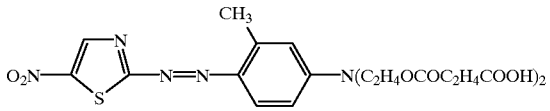
(10)
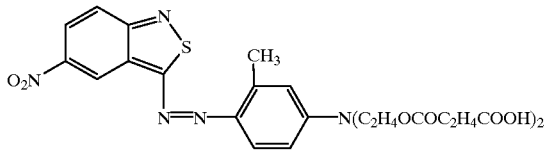

-continued
(11)
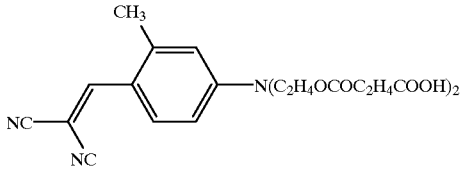
(12)
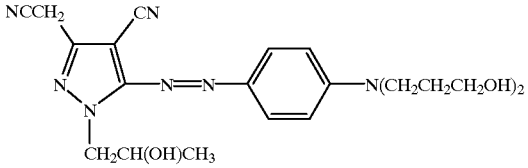
(13)
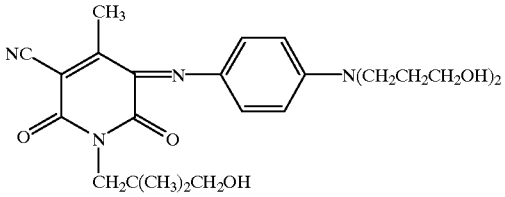
(14)
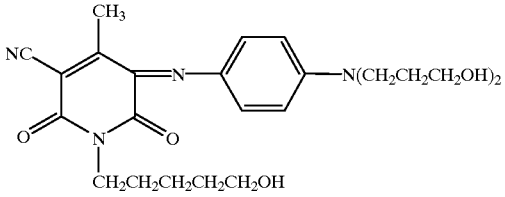
(15)
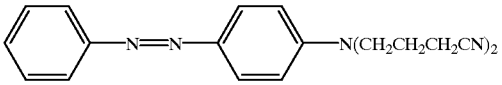
(16)
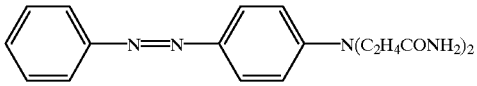
(17)
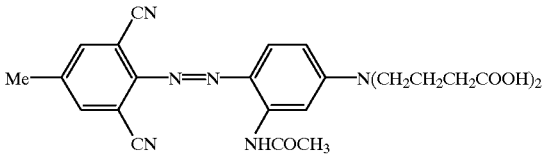
(18)
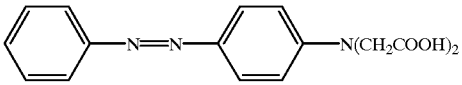

-continued
(19)
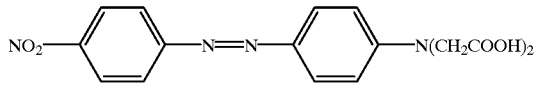
(20)
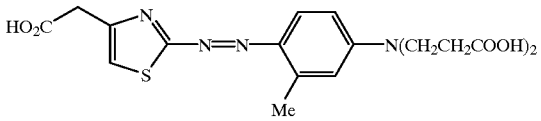
(21)
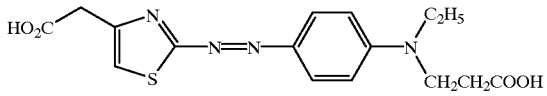
(22)
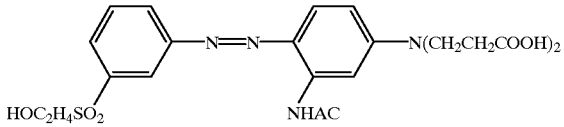
(23)
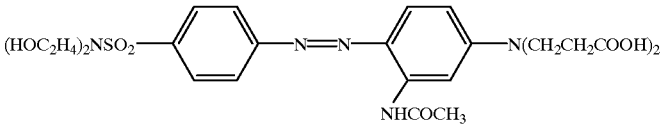
(24)
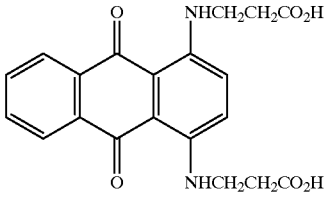
(25)
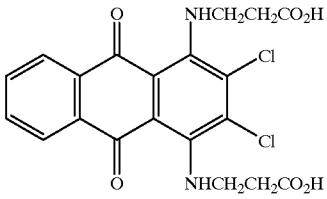
(26)
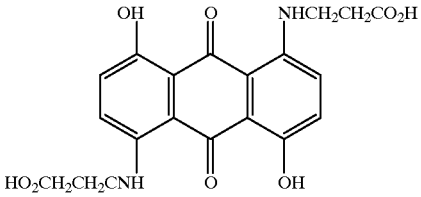

-continued
(27)
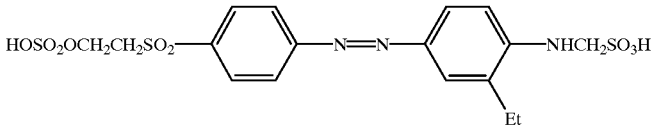
(28)
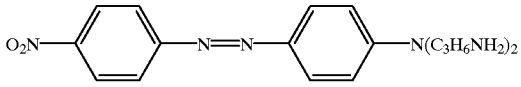
(29)
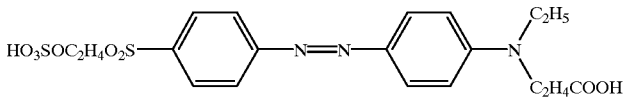
(30)
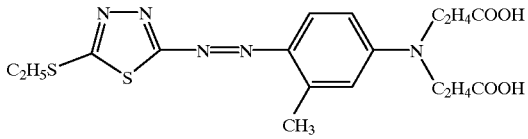
(31)
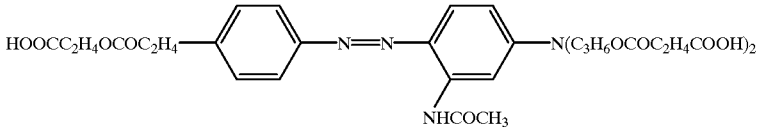
(32)
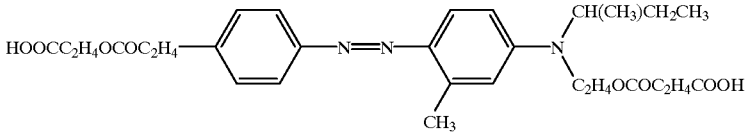
(33)
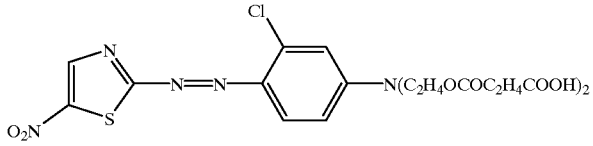
(34)
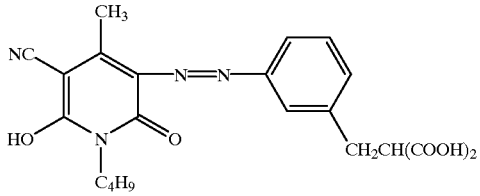

-continued
(35)
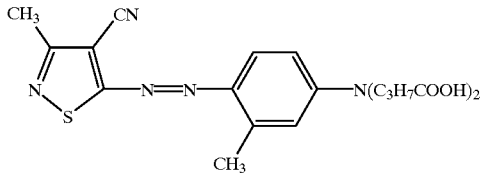
(36)
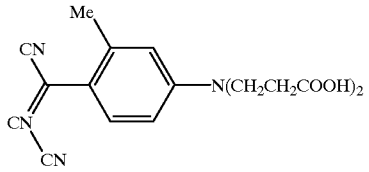
(37)
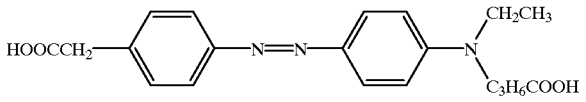
(38)
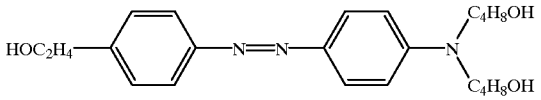
(39)
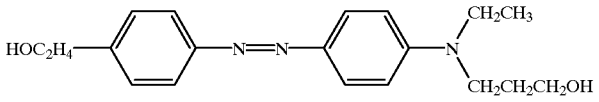
(40)
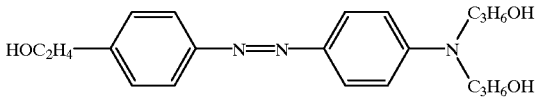
(41)
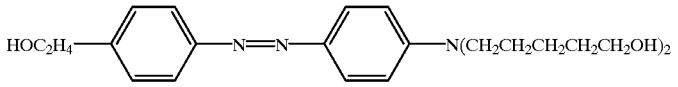
(42)
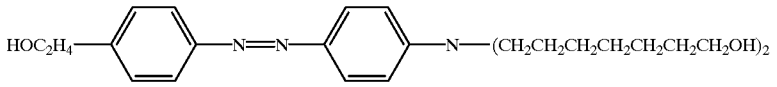
(43)
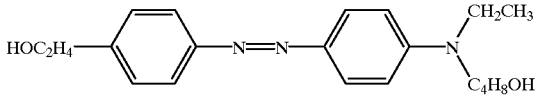

-continued
(44)
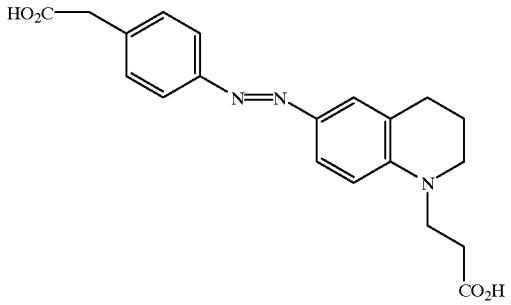
(45)
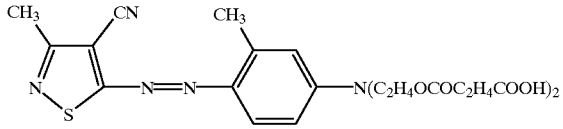
(46)
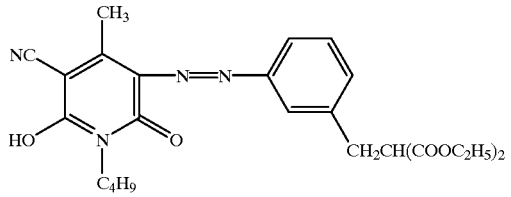
(47)
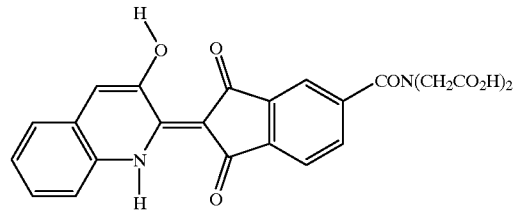
(48)
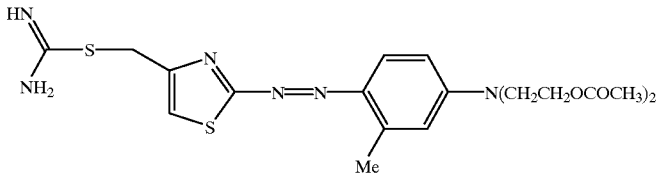
(49)
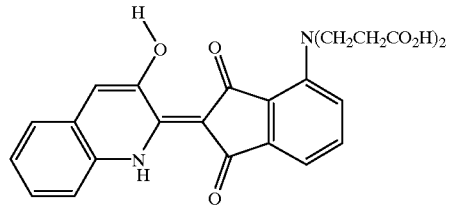

-continued (50)

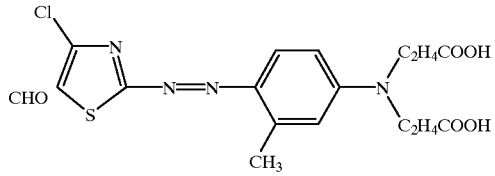

We claim:

1. A dye diffusion thermal transfer printing dye sheet comprising a substrate having a coating comprising a dye of Formula (1):

Formula (1)

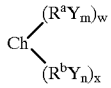

wherein

Ch is a chromogen;

$R^a$ and $R^b$ each independently is a spacer group;

Y is an interactive functional group selected from the group comprising OH and COOH;

w and x each independently is 0 or an integer equal to or greater than 1; and m and n each independently is an integer equal to or greater than 1, provided that w and x are not both equal to 0 and when one of w or x is 0 at least one of m and n is equal to or greater than 2 and when Y represents hydroxy, m+n is greater than 2.

2. The dye sheet according to claim 1, wherein the interactive functional groups are the same or different.

3. The dye sheet according to claim 1, wherein the spacer groups each comprise an atom or groups of atoms connected to Ch by at least one sigma bond and to Y by at least one sigma bond.

4. The dye sheet according to claim 3, wherein the spacer groups contain at least one of a carbon, silicon or sulphur atom.

5. The dye sheet according to claim 4, wherein the spacer groups contain at least two carbon atoms.

6. The dye sheet according to claim 4, wherein the spacer groups contain from 3 to 10 carbon atoms.

7. The dye sheet according to claim 1, wherein the chromogen is an optionally substituted group of Formula (2)

Formula 2

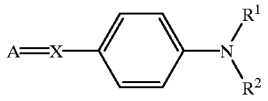

or the chromogen is an optionally substituted group of Formula (2B)

Formula 2B

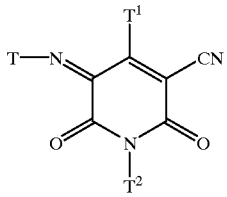

wherein

T is an $A^1$-NH or an optionally substituted phenyl;

$A^1$ is the residue of a diazotisable aromatic or heteroaromatic amine;

$T^1$ is optionally substituted $C_1$–$C_{12}$ alkyl or optionally substituted aryl;

$T^2$ is optionally substituted alkyl;

or the chromogen is an optionally substituted group of Formula (3)

Formula 3

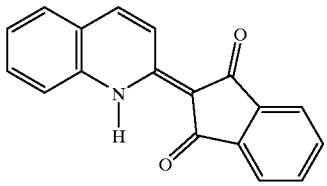

or the chromogen is an optionally substituted group of Formula (4)

Formula 4

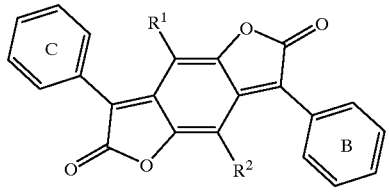

wherein rings B and C are optionally substituted; or the chromogen is an optionally substituted group of Formula (5)

Formula 5

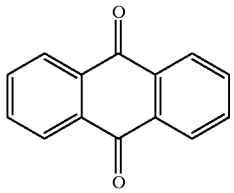

wherein $R^1$ and $R^2$ each independently represents a hydrogen atom, alkyl, alkoxy or halogen, X is —C(R)— or N and R represents a hydrogen atom, CN or COOalkyl, and A is $A^1$-N or A is an optionally substituted group of Formula (6)

Formula 6

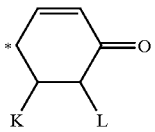

wherein K and L each independently represents —CN, $NO_2$, —Cl, —F, —Br, $C_{1-6}$ alkyl, $C_{1-6}$ alkoxy, —$NHCOC_{1-6}$ alkyl, —NHCOphenyl, —$NHSO_2$ alkyl, —$NHSO_2$ phenyl or aryloxy, or K and L together with the carbon atoms to which they are attached form a 5- or 6-membered carbocyclic or heterocyclic ring;

or A is an optionally substituted group of Formula (7);

Formula 7

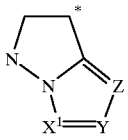

wherein $X^1$, Y and Z each independently represents N or C—$R^3$ wherein $R^3$ represents a hydrogen atom, CN, alkyl, alkoxy, cycloalkyl, aryl, aralkyl, aryloxy, or amino;

or A is an optionally substituted group of Formula (8)

Formula 8

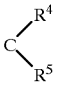

wherein $R^4$ and $R^5$ each independently is an electron withdrawing group or $R^4$ and $R^5$ may be joined to form a heterocyclic ring such as or A is an optionally substituted group of Formula 9:

Formula 9

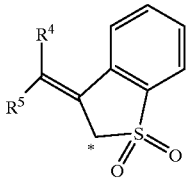

wherein $R^4$ and $R^5$ are as hereinbefore defined;

or A is an optionally substituted group of Formula 10

Formula 10

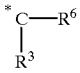

wherein $R^3$ is as hereinbefore defined and $R^6$ is alkenyl;

where * indicates the point of attachment of the groups of Formulae 6 to 10 to the double bond in Formula (2).

8. The dye sheet according to claim 7, wherein $A^1$ is selected from the group comprising phenyl, naphtyl, thiazolyl, isothiazolyl, benzothiazolyl, pyrazolyl, thiadiazolyl, imidazolyl, thienyl, pyridyl and pyridoisothiazolyl each of which may be substituted.

9. The dye sheet according to claim 7, wherein the chromogen contains an alpha-branched N-alkyl group.

10. The dye sheet according to claim 1, wherein the dye has a melting point in the range from 20° C. to 200° C.

11. The dye sheet according to claim 1, further comprising a material for absorbing and converting light radiation to heat.

12. A dye diffusion thermal transfer printing dye sheet/receiver sheet combination comprising a dye sheet and a receiver sheet, wherein the dye sheet comprises a substrate having a coating comprising a dye of Formula (1):

Formula (1)

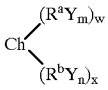

wherein:

Ch is a chromogen;

$R^a$ and $R^b$ each independently is a spacer group;

Y is an interactive functional group;

w and x each independently is 0 or an integer equal to or greater than 1; and m and n each independently is an integer equal to or greater than 1, provided that w and x are not both equal to 0 and when one of w or x is 0 at least one of m and n is equal to or greater than 2 and when Y represents hydroxy, m+n is greater than 2; except for dyes having the following formulae:

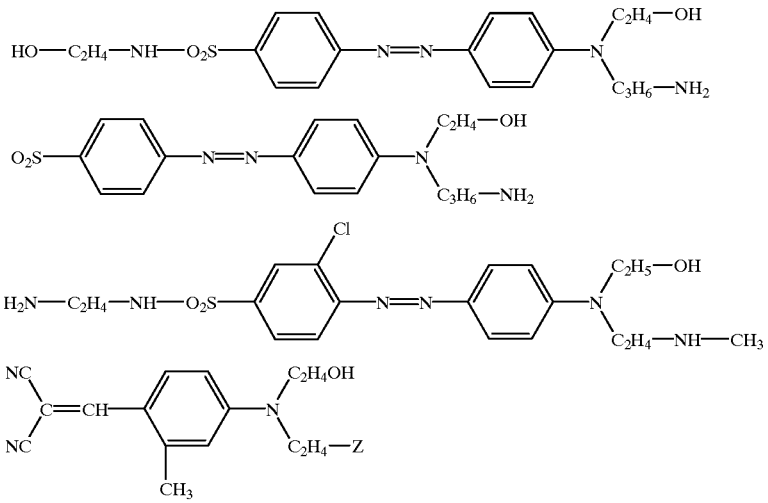

where Z is an acetyloxy group

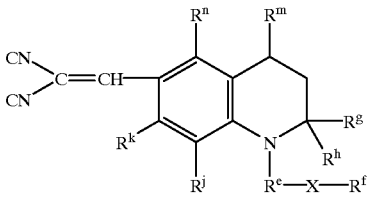

wherein $R^g$, $R^h$, $R^k$, $R^m$ are methyl groups, $R^j$ and $R^n$ are hydrogen groups, $R^e$ is

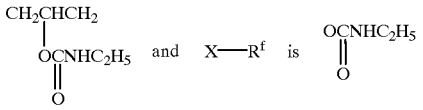

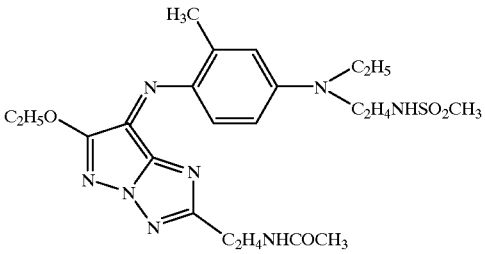

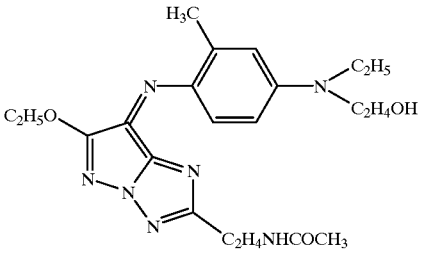

-continued

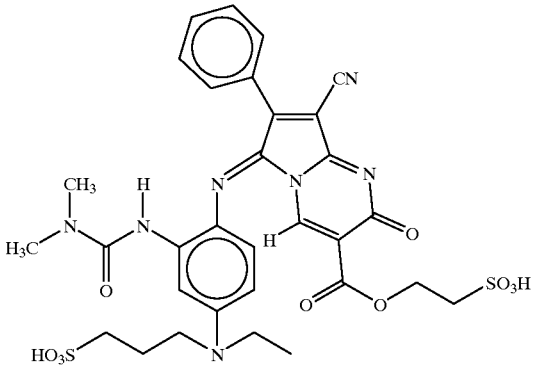

and wherein the receiver sheet contains a polymer having at least one group capable of interacting with Y, the polymer containing at least one group selected from =N, $NR_2$, NRH, $NH_2$, OH, COOH, $SO_3H$ in which R is selected from —CN, $NO_2$, —Cl, —F, —Br, —$C_{1-6}$alkyl, $C_{1-6}$alkoxy, —$NHCOC_{1-6}$alkyl, —NHCOphenyl, —$NHSO_2$alkyl, —$NHSO_2$phenyl or aryloxy.

13. The combination according to claim 12, wherein the interactive functional groups are the same or different.

14. The combination according to claim 13, wherein at least one of the interactive functional groups contains at least one hydrogen atom.

15. The combination according to claim 13, wherein the interactive functional groups are selected from the group comprising OH, $NH_2$, NHR, $NR_2$, COOH, $CONH_2$, NHCOR, CONHR, $SO_2NH_2$, $SO_2NHR$, $SO_3H$, $NHCONH_2$, NHCONHR, =NOH, and $PO_3H$, in which R is selected from —CN, $NO_2$, —Cl, —F, —Br, —$C_{1-6}$alkyl, $C_{1-6}$alkoxy, —$NHCOC_{1-6}$alkyl, —NHCOphenyl, —$NHSO_2$alkyl, —$NHSO_2$phenyl or aryloxy.

16. The combination according to claim 15, wherein the interactive functional groups are selected from the group comprising OH, $NH_2$, NHR, $NR_2$, COOH, $CONH_2$, CONHR, $SO_2NH_2$, $SO_2NHR$, and =NOH, in which R is selected from —CN, $NO_2$, —Cl, —F, —Br, —$C_{1-6}$alkyl, $C_{1-6}$alkoxy, —$NHCOC_{1-6}$alkyl, —NHCOphenyl, —$NHSO_2$alkyl, —$NHSO_2$phenyl or aryloxy.

17. The combination according to claim 15, wherein the interactive functional groups are selected from the group comprising $NH_2$, NHR and $NR_2$.

18. The combination according to claim 15, wherein the interactive functional groups are selected from the group comprising OH and COOH.

19. The combination according to claim 15, wherein the interactive functional groups are COOH.

20. The combination according to claim 12, wherein the spacer groups each comprise an atom or group of atoms connected to Ch by at least one sigma bond and to Y by at least one sigma bond.

21. The combination according to claim 20, wherein the spacer groups contain at least one of a carbon, silicon or sulphur atom.

22. The combination according to claim 21, wherein the spacer groups contain at least two carbon atoms.

23. The combination according to claim 21, wherein the spacer groups contain from 3 to 10 carbon atoms.

24. The combination according to claim 12, wherein the chromogen is an optionally substituted group of Formula (2)

Formula 2

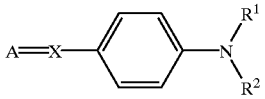

or the chromogen is an optionally substituted group of Formula (2B)

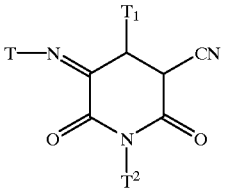

wherein

T is an $A^1$-NH or an optionally substituted phenyl;

$A^1$ is the residue of a diazotisable aromatic or heteroaromatic amine;

$T^1$ is optionally substituted $C_1$–$C_{12}$ alkyl or optionally substituted aryl;

$T^2$ is optionally substituted alkyl;

or the chromogen is an optionally substituted group of Formula (3)

Formula 3

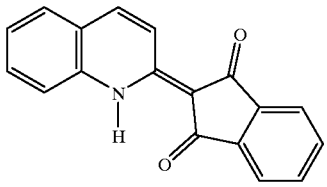

or the chromogen is an optionally substituted group of Formula (4)

Formula 4

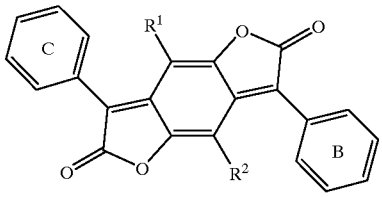

wherein rings B and C are optionally substituted and $R^1$ and $R^2$ each independently represents a hydrogen atom, alkyl, alkoxy or a halogen;

or the chromogen is an optionally substituted group of Formula (5)

Formula 5

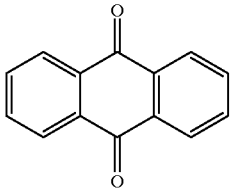

wherein

X is —C(R)— or N and R is H, CN or COalkyl, and

A is $A^1$-N or A is an optionally substituted group of Formula (6)

Formula 6

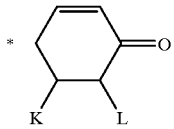

wherein K and L each independently is —CN, $NO_2$, —Cl, —F, —Br, $C_{1-6}$ alkyl, $C_{1-6}$ alkoxy, —$NHCOC_{1-6}$ alkyl, —NHCOphenyl, —$NHSO_2$ alkyl, —$NHSO_2$ phenyl or aryloxy, or K and L together with the carbon atoms to which they are attached form a 5- or 6-membered carbocyclic or heterocyclic ring; or A is an optionally substituted group of Formula (7):

Formula 7

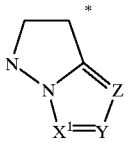

wherein $X^1$, Y and Z each independently is N or C—$R^3$ in which $R^3$ is H, CN, alkyl, alkoxy, cycloalkyl, aryl, aralkyl, aryloxy, or amino; or A is an optionally substituted group of Formula 8.

Formula 8

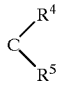

wherein $R^4$ and $R^5$ each independently is an electron withdrawing group or $R^4$ and $R^5$ may be joined to form a heterocyclic ring such as or A is an optionally substituted group of Formula 9:

Formula 9

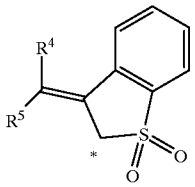

in which $R^4$ and $R^5$ are as hereinbefore defined; or A is an optionally substituted group of Formula 10

Formula (10)

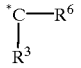

wherein $R^3$ is as hereinbefore defined and $R^6$ is alkenyl;

where * indicates the point of attachment of the groups of Formulae 6 to 10 to the double bond in Formula (2).

25. The combination according to claim 24, wherein $A^1$ is selected from the group comprising phenyl, naphtyl, thiazolyl, isothiazolyl, benzothiazolyl, pyrazolyl, thiadiazolyl, imidazolyl, thienyl, pyridyl and pyridoisothiazolyl each of which may be substituted.

26. The combination according to claim 24, wherein the chromogen contains an alpha-branched N-alkyl group.

27. The combination according to claim 12, wherein the dye has a melting point in the range from 20° C. to 200° C.

28. The combination according to claim 12, further comprising a material for absorbing and converting light radiation to heat.

* * * * *